US006299369B1

(12) United States Patent
Baines et al.

(10) Patent No.: US 6,299,369 B1
(45) Date of Patent: Oct. 9, 2001

(54) DISPENSER

(75) Inventors: Roger Anthony Baines, Leeds; Martin Christopher Bunce, Marlborough; Robert David James, Poole; Russell Jones, Bourne End, all of (GB)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 0 days.

(21) Appl. No.: 09/684,606

(22) Filed: Oct. 6, 2000

(30) Foreign Application Priority Data

Oct. 8, 1999 (GB) ..... 9923923

(51) Int. Cl.[7] ..... A45D 40/04; A45D 40/06
(52) U.S. Cl. ..... 401/75; 401/82; 401/175
(58) Field of Search ..... 401/68, 69, 75, 401/82, 116, 175, 174, 172

(56) References Cited

U.S. PATENT DOCUMENTS 3,612,705 * 10/1971 Duval ..... 401/75
5,868,510 2/1999 Lacout et al. ..... 401/175 X

FOREIGN PATENT DOCUMENTS 0713660 5/1996 (EP) .
96/03899 2/1996 (WO) .

* cited by examiner

*Primary Examiner*—Gregory L. Huson
*Assistant Examiner*—Kathleen J. Prunner
(74) *Attorney, Agent, or Firm*—Matthew Boxer

(57) ABSTRACT

A dispenser for a solid or soft solid mass has a barrel, a piston within the barrel, and a mechanism for advancing the piston axially within the barrel including a rotor wheel. A boss having an inwardly tapered profile (tear drop) and a sump dimensioned to receive the boss seats the rotor wheel at a predetermined angular position relative to the barrel. The boss is preferably formed on the rotor wheel and the sump in the base of the barrel. The dispenser is provided with a pair of bosses and sumps, symmetrically arranged around the rotor wheel and barrel base.

14 Claims, 4 Drawing Sheets

Fig.2.
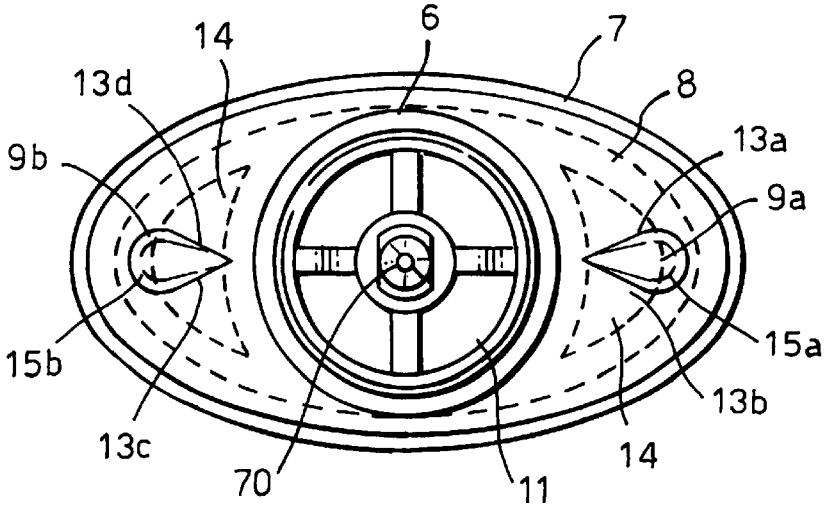
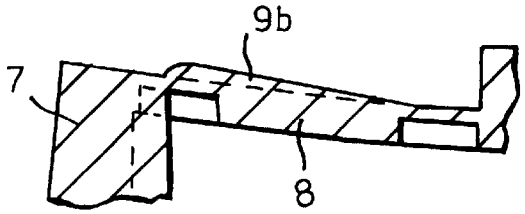
Fig.3.
Fig.4.
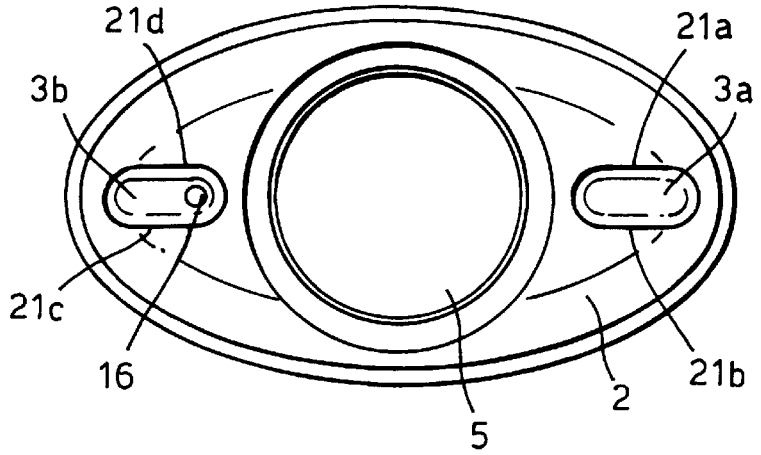
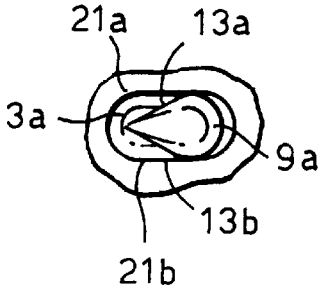
Fig.5.

DISPENSER

The present invention relates to a dispenser, in particular to a dispenser for a solid block or soft solid mass and especially for dispensing a cosmetic or toiletry or material for personal or household use.

BACKGROUND

A number of known containers (alternatively referred to as dispensers) for a solid block or soft solid mass, such as dispensers in particular, for cosmetic materials or toiletries or other materials for personal or household use, comprise a barrel having one end through which the material can be dispensed, that end being open for dispensing a solid block or closed by an apertured cap for dispensing a soft solid mass. A rotor wheel is mounted at the opposite end of the barrel, and is fixed to a threaded rod which extends axially within the barrel and engages a correspondingly threaded mounting in a follower, a piston located within the barrel. When the rotor wheel is rotated, the threaded rod is likewise rotated and engages with the corresponding threading on the mounting of the piston, thereby translating the rotational movement of the rod into axial movement of the piston.

The transverse cross section of the barrel is at the discretion of the producer, commonly being either round or oval. The rotor wheel has typically comprised a round wheel projecting through opposed windows in a skirt depending from the base of the barrel. An alternative type of rotor wheel, as described in U.S. Pat. No. 3,612,705 and subsequently in EP-A-713660, comprises a wheel having approximately the same transverse cross section as the barrel and mounted underneath the barrel. Such an arrangement is particularly suitable for a non-circular barrel and wheel, for example, an oval barrel and wheel, because rotation of the wheel out of and into alignment with the barrel provides a readily apparent and effective means to meter the solid block or soft solid mass of material out of the dispenser. In U.S. Pat. No. 3,612,705, U.S. Pat. No. 5,868,510 and EP-A-813829 there is also described the location of small round bosses on the top surface of the rotor wheel and complementary shallow sockets indented into the bottom surface of the base of the barrel to align the rotor wheel with the barrel on each turn of the wheel. The present inventors recognise that this has benefits not only during the dispensing operation, but also preventing the wheel and base to become misaligned during transportation of the dispenser before it is filled. However, the design described in U.S. Pat. No. 3,612,705 presents a number of difficulties in practice for its smooth and effective implementation. The barrel is often produced by injection moulding of a thermoplastic, and the gate into the mould is normally located at the bottom of the barrel. The residual excess plastic in the gate forms an irregular protuberance beneath the bottom surface of the barrel which can impair the smooth rotation of rotor wheel. The alignment of a small round boss with a corresponding shallow socket is comparatively difficult because even a small spacial displacement can result in misalignment. Furthermore, when the small round boss on the wheel is rotated into contact with the edge of the bottom of the barrel, the vertical displacement of the wheel from the barrel bottom in order to accommodate the boss must be achieved suddenly due to the sharp profile of the boss. This has a number of effects. Impact of the boss at the same point at the base of the barrel wall can cause damage to the wall or to the boss, and with repeated turnings of the wheel relative to the barrel can result in the boss being worn away, so that it ceases to be effective eventually to perform an alignment function. Because a round boss provides approximately a point contact with the wall of the barrel on rotation, the impact is sudden and the resistance to rotation great, so that wheel rotation encounters a sudden stiffness.

It is an objective of the present invention to mitigate or avoid one or more of the difficulties described hereinabove.

BRIEF DESCRIPTION

According to the present invention there is provided a dispenser for a solid block or a soft solid comprising:

i) a barrel having a first end through which the solid block or soft solid is dispensed, and an opposite end comprising a base wall defining an aperture and having a lower surface;

ii) a rotor wheel mounted beneath the barrel having a transverse cross-section similar to the barrel and a top surface contiguous with the lower surface of the barrel;

iii) a threaded spindle fixed to the rotor wheel and extending axially through the aperture in the base wall of the barrel;

iv) a piston within the barrel having a threaded mounting that engages the spindle and moves axially on rotation of the spindle;

in which, v) one of the base wall of the barrel or the top surface of the rotor wheel carries a radially extending boss having an inwardly tapered profile and the other of the base wall or the top surface has an sump dimensioned to accommodate the boss and in which the boss is seated when the rotor wheel and barrel are aligned.

By the employment of a boss having an inwardly tapering profile, the contact is gradual between the boss and the surface which it encounters during relative rotation of the rotor wheel and barrel. This alleviates or eliminates at least some of the difficulties identified hereinabove for a round boss.

DETAILED DESCRIPTION

The present invention provides a dispenser for dispensing material in the form of a solid block or soft solid in which the material is propelled upwardly within a barrel by a piston that is axially moveable by engagement with a threaded spindle fixed to a rotor wheel mounted beneath the barrel, in which the base of the barrel and the top surface of the rotor wheel are aligned by seating a tapered boss on one of the barrel base surface or rotor wheel top surface into a corresponding sump in the other surface.

Preferably, the boss is located on the rotor wheel and the sump in the base of the barrel, at least partly because it is desirable to have a relatively stiff base for the barrel. By employing a hollow rotor wheel, it is possible to have a rotor wheel with a relatively flexible top surface that is contiguous with the base of the barrel and that is reinforced in the vicinity of its mounting into the barrel. This is particularly valuable, enabling the top surface to flex in the vicinity of the boss, particularly when the top surface is thinned in the vicinity of the boss. Such flexibility enables the surface of the rotor wheel to be displaced vertically away from the barrel base surface when the boss encounters the base. Especially in cooperation with the tapered profile of the boss, this minimises the resistance to the boss climbing onto and subsequently riding across the surface of the base. By easing the way in which the boss climbs onto and rides across the base surface, the risk of damage to the boss or to the surface of the base is reduced, thereby preserving the ability of the boss to perform its locating function.

On rotation of the rotor wheel relative to the barrel, the boss produces an audible sound, or click, as it drops into the sump, thereby providing an additional cue to the user that a unit volume of cosmetic material has been dispensed from the barrel. The tapered profile of the boss minimises the sound as it engages the base surface before it encounters the sump, thereby minimising the risk that a click could be heard before the sump is reached and thereby avoiding confusing the user as to the amount of material dispensed if he or she were to hear a premature click.

It is preferable to employ a plurality of boss/sumps, most desirably disposed symmetrically around the barrel base/rotor wheel. Many useful dispensers according to the present invention are oval in transverse cross section, and in such dispensers, it is preferable to employ two bosses/sumps located on the major transverse axis of the dispenser. Particularly preferable, the boss is located adjacent to the sidewall of the dispenser.

The boss in many preferred dispensers has a taper angle of from 9 to 18°. In a number of dispensers the ratio of boss height to radial length is from 10:1 to 25:1.

The boss advantageously can have an inward taper when viewed in transverse cross section on the side of the boss encountering the base (or as the case may be, rotor wheel) surface. It is preferable for both sides of the boss to be tapered, and preferably symmetrically tapered, because it is preferable for the rotor wheel to be turned both ways, both to dispense and also to retract, particularly when dispensing a solid block. The inward tapering of the boss is beneficial in that it reduces the contact angle between the boss and the base (or wheel) wall that it is encountering by the angle of taper, thereby enabling the boss to climb more smoothly over that wall. The side walls and end wall of the boss are often radiused to the top of the boss. The boss, in many instances, tapers to a point. The ratio of radial length to transverse width of the boss is often selected in the range of from 4:3 to 2:1. The ratio of the radial length to boss to the radius of base/wheel on which it sits in the invention's dispenser is commonly selected in the range of from 1:4 to 2:5. Such relative dimensions of the boss are particularly suitable for dispensers intended to dispense in the region of from 15 to 150 mls of material. It is especially suitable for the boss to be located at a radial distance from the axial centre of the rotor wheel that is greater than the minor radius of the barrel.

The or each sump which acts as a seating for the boss desirably has a depth just sufficient to accommodate the maximum height of the boss. It could, if desired, be dimensioned to fit the boss. However, especially conveniently, it is lozenge shaped, having a transverse width just wider than the maximum width of the boss. A lozenge shaped sump has a radially extending edge which is angled relative to the leading boss side wall as it is rotated, thereby assisting the boss to climb smoothly out of the sump. For example, the sump edge may be substantially aligned to the longitudinal axis of the barrel and the boss side wall inclined at an angle, or the reverse can be contemplated. Namely, the boss side wall being substantially aligned with the longitudinal axis of the barrel and the sump edge being inclined. The sump's radial length is desirably a little longer than the boss to accommodate radial play in the dispenser.

The barrel is often non-circular, such as oval, in cross section, although circular barrels can be contemplated. The rotor wheel, advantageously, in some embodiments, has the same shape and external dimensions as the barrel.

The dispenser is normally manufactured from thermoplastics, such as high density polyethylene or polypropylene and particularly by injection moulding methods. The plastic is injected into a mould through a gate, and residual material forms an irregular protuberance. It is particularly convenient to locate that protuberance within the sump, and especially as close as is practicable to the centre of the base.

The base of the barrel and the top surface of the rotor wheel are continuous, by which is meant that the two surfaces are in contact over at least the greater part of their transverse surface area when the barrel and rotor wheel are aligned. The two surfaces can be flat planar, if desired. However, the surfaces can be radiused in one dimension, the one being convex and the other concave when viewed along the minor axis of the barrel. Preferably, the barrel base has the convex profile.

The rotor wheel can desirably have a moulding in its side wall acting as a locator for a thumb, to guide the user as to the direction of rotation for dispensing material from the barrel.

The top of the barrel may define an aperture through which a solid block is dispensed or it may be closed by a closure having one or more openings in fluid communication with the interior of the barrel for dispensing a soft solid. Such barrels may be capped, as is conventional, or the openings plugged by a removable plug.

Having described the invention in general terms, specific embodiments thereof will now be described in greater detail with reference to the accompanying Figures in which:

FIG. 2 represents a plan view from above of the rotor wheel.

FIG. 3 represents an expanded cross section of the rotor wheel in the vicinity of the boss.

FIG. 4 represents a plan view from below of the base of the barrel.

FIG. 5 represents a plan view of the boss sited within the corresponding sump.

Figure 1:
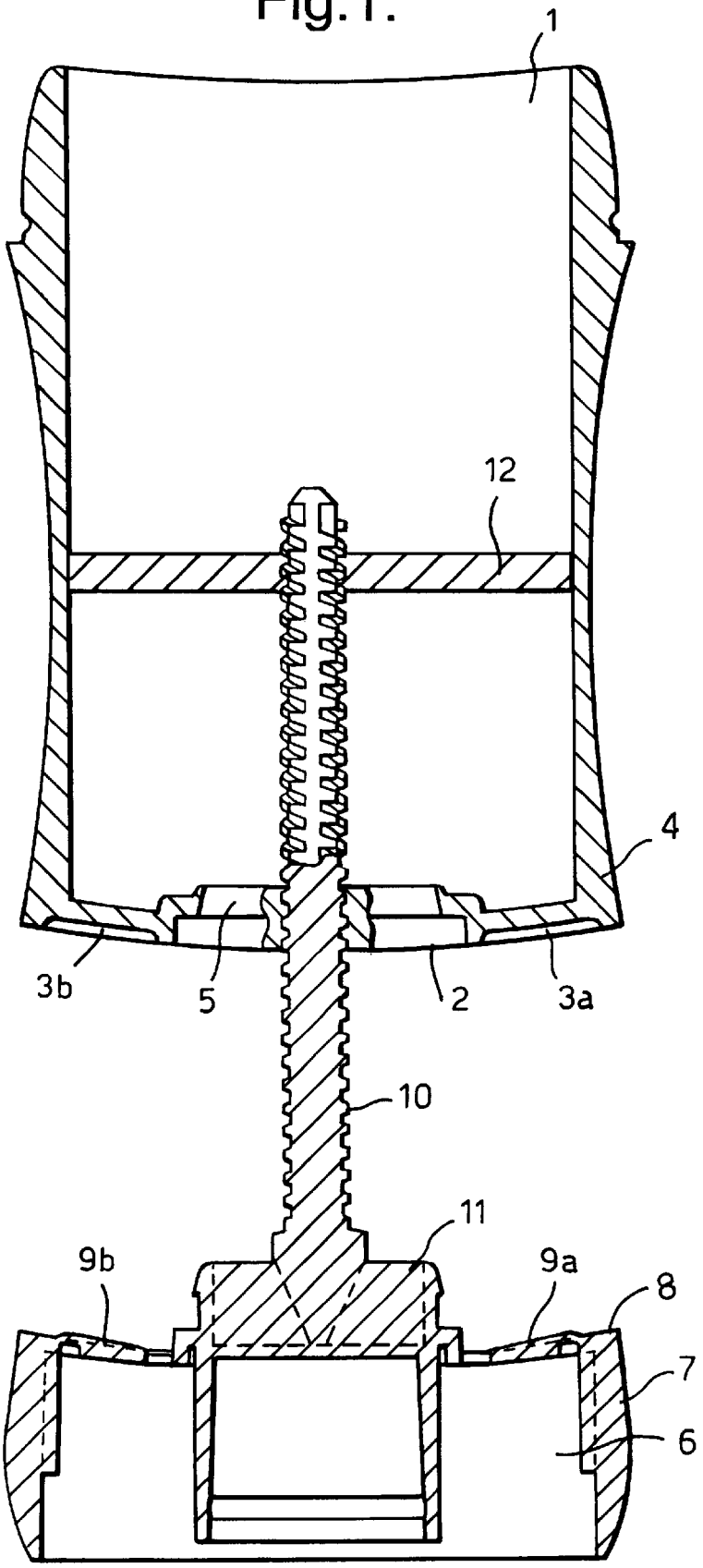
FIG. 1 represents an exploded cross-section through an oval barrel and rotor wheel/spindle viewed from their minor axis.
Figure 6:
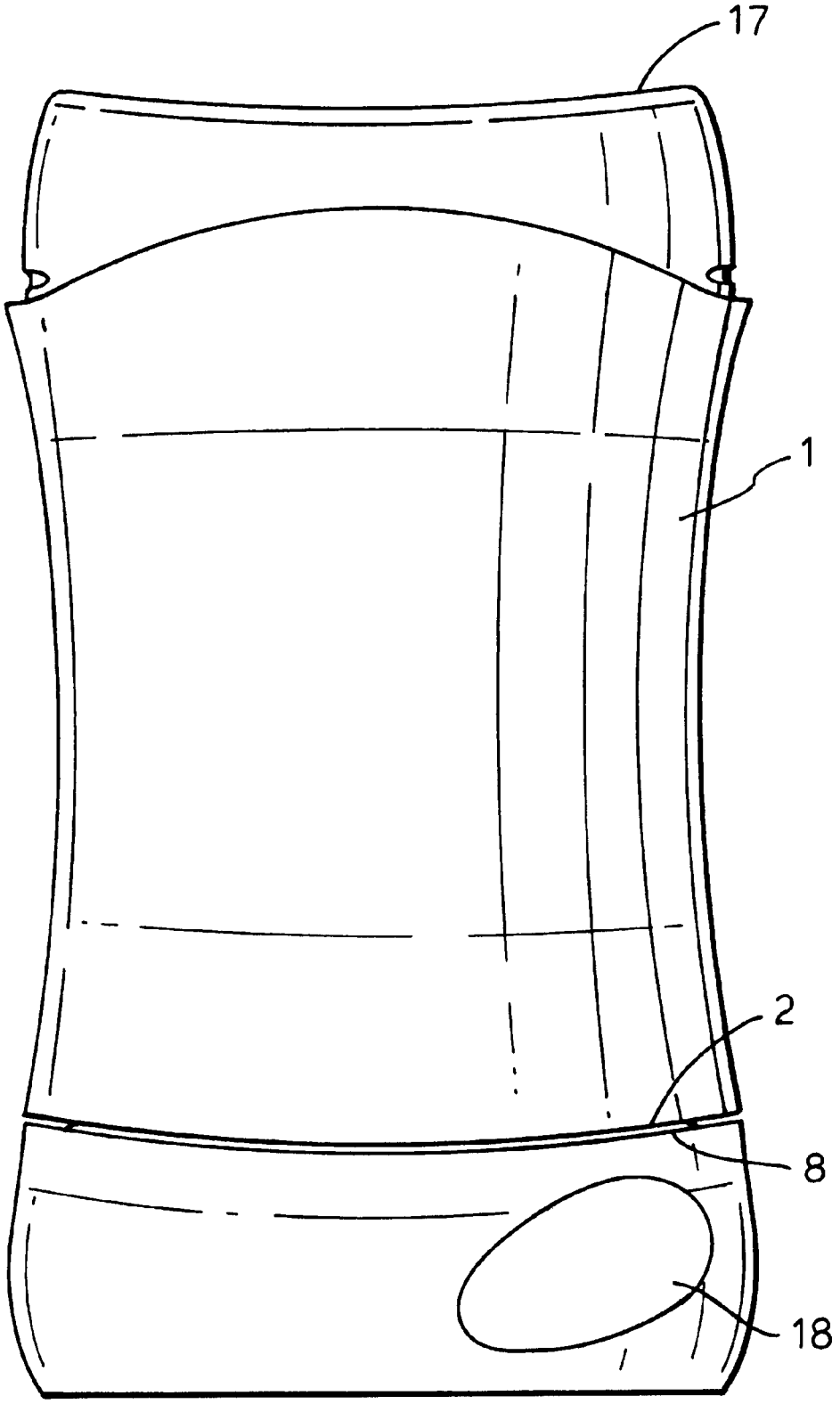
FIG. 6 represents a side view of a barrel and rotor wheel for dispensing a solid block.
Figure 7:
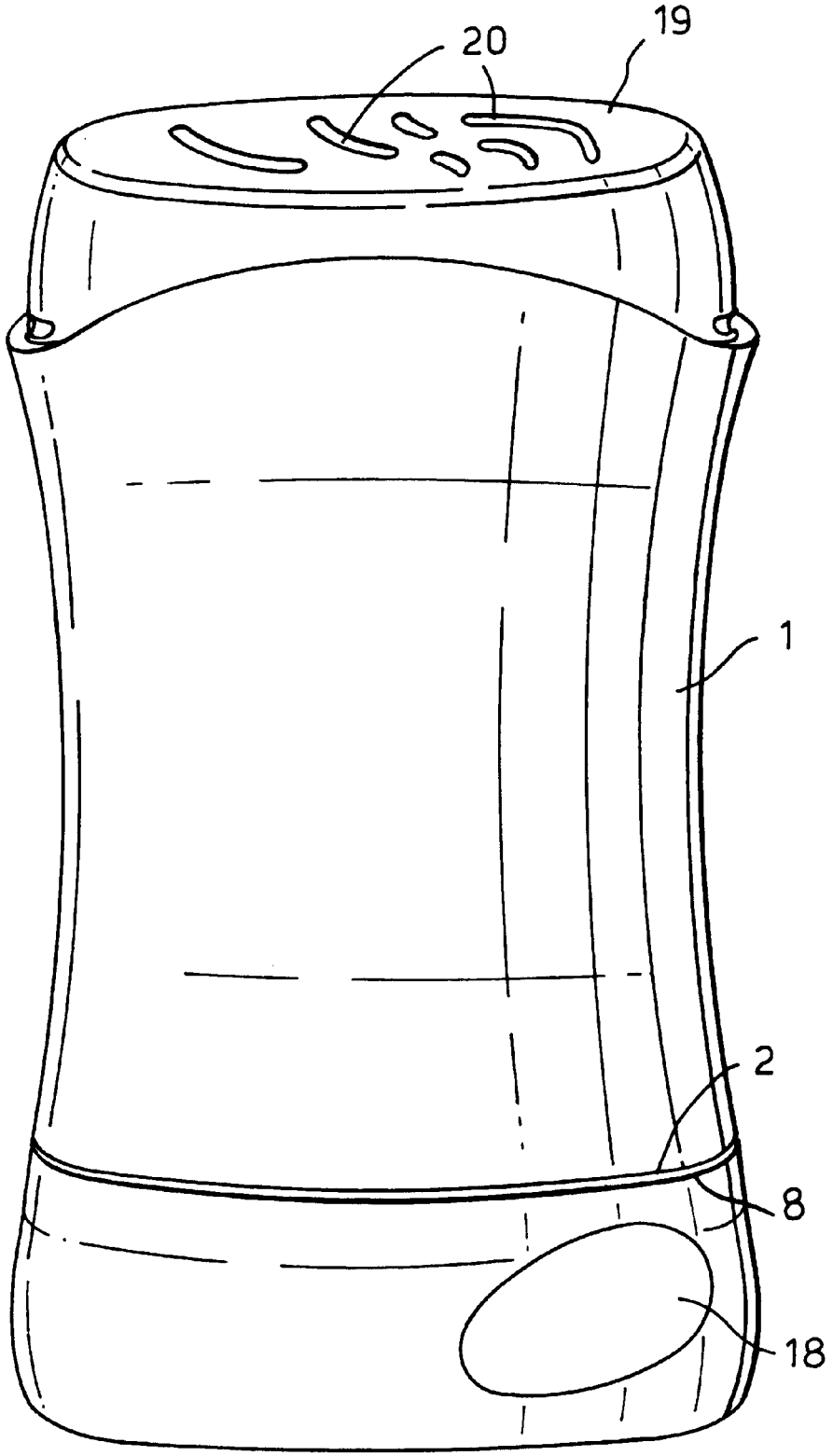
FIG. 7 represents a top/side view of a barrel for dispensing a soft solid.

A dispenser for dispensing a solid block is described with respect to FIGS. 1 to 6, and a dispenser for dispensing a soft solid in FIGS. 1 to 5 plus 7.

The dispenser shown in FIGS. 1 to 6 comprises an oval barrel 1 and a rotor wheel 6 forming a hollow member. The barrel 1 has a convex base 2 in which are formed two sumps 3*a* and 3*b* which are lozenge shaped and extend radially, terminating in close proximity to the side wall 4 of the barrel. The base 2 defines an aperture 5.

The rotor wheel 6 is located beneath the barrel 1 and is hollow, comprising a sidewall 7 and a concave topwall 8. Two bosses 9*a* and 9*b* are moulded integrally onto the topwall 8. A threaded spindle 10 is fixed into a central mounting 11 in the rotor wheel 6. A threaded piston 12 engages with the threaded spindle 10. The bosses 9*a* and 9*b* are inclined to the rotor wheel top surface 8 at 12° (taper angle) and have a tear-drop shape in plan view, having symmetrical inwardly tapering sides respectively 13*a*, 13*b* and 13*c*, 13*d*. The top surface 8 is thinned in the vicinity 14 of the bosses 9*a* and 9*b*. The bosses 9*a* and 9*b* each have a radiused side/end wall 15*a* and 15*b*.

The sumps 3*a* and 3*b* have inclined sides respectively 21*a*, 21*b* and 21*c*, 21*d* which are parallel with the major transverse axis of the barrel 1 and acutely angled to the respective sidewalls of the bosses, 13*a*, 13*b* and 13*c*, 13*d*. The relative angle of inclination of sidewalls 13*a*, 13*b* to sides 21*a*, 21*b* enables the boss 9*a* to exit smoothly from the sump 3*a* by rotation of the rotor wheel 6 relative to the barrel 1 and likewise boss 9*b* from sump 3*b*. Sump 3*b* houses an irregular protuberance 16 which comprises residual thermoplastic in the mould gate during manufacture of the barrel 1. The protuberance 16 is sufficiently small that it does not engage with boss 9*b* when the boss 9*b* is located in the sump 3*b*.

The barrel for dispensing a solid block has an open end 17 and the rotor wheel has a thumb locating sump 18. The barrel for dispensing soft solid has a closure 19 having a plurality of openings 20.

In manufacture, the mounting 11 in the rotor wheel 6 is snap fitted in to aperture 5 in the base 2 of the barrel 1, and the piston 12 engaged with the spindle 10 near the base of the barrel 1. The rotor wheel 6 is rotated until the bosses 9*a* and 9*b* are in alignment with the sumps 3*a* and 3*b*. The barrel 1 is top filled with desired material.

In operation, the rotor wheel 6 is rotated relative to the barrel 1, each boss 9*a* and 9*b* climbing out of sumps 3*a* and 3*b* respectively. The top surface 8 of the rotor wheel 6 flexes in the regions 14 adjacent to the bosses 9*a*, 9*b* assisting the climb. The rotor wheel 6 continues to be rotated in the same direction of rotation. Next, as the bosses 9*a*, 9*b* emerge from beneath the barrel 1, the top wall 8 flexes and again as they encounters the side wall of the barrel. Rotation continues until the bosses again are seated in the opposite sump, ie boss 9*a* in sump 3*b* and 9*b* in 3*a*. An audible click can be heard as the bosses 9*a* and 9*b* drop into sumps 3*a* and 3*b* respectively and strike the base of the barrel. The operation is repeatable at the discretion of the user until sufficient material is judged to have been dispensed. If excess material has been dispensed, the rotor wheel can be rotated in the reverse direction to lower the piston 12, and retract material into the barrel 1.

What is claimed is:

1. A dispenser for a solid block or a soft solid comprising:

i) a barrel having a first end through which the solid block or soft solid is dispensed, and an opposite end comprising a base wall defining an aperture and having a lower surface;

ii) a rotor wheel mounted beneath the barrel having a transverse cross-section similar to the barrel and a top surface contiguous with the lower surface of the barrel;

iii) a threaded spindle fixed to the rotor wheel and extending axially through the aperture in the base wall of the barrel;

iv) a piston within the barrel having a threaded mounting that engages the spindle and moves axially on rotation of the spindle;

in which v) one of the base wall of the barrel or the top surface of the rotor wheel carries an elongated radially extending boss having symmetrical inwardly tapered and substantially linear sides and the other of the base wall or the top surface has a sump dimensioned to accommodate the boss and in which the boss is seated when the rotor wheel and barrel are aligned.

2. A dispenser according to claim 1 in which there are at least two bosses and corresponding sumps symmetrically positioned around the rotor wheel and base wall of the barrel.

3. A dispenser according to claim 1 in which the rotor wheel carries the boss and the base wall of the barrel carries the sump.

4. A dispenser according to claim 3 in which the rotor wheel has a flexible top surface in the vicinity of the boss.

5. A dispenser according to claim 4 in which the rotor wheel comprises a hollow member having a flexible top surface that is reinforced in the vicinity of its mounting into the barrel.

6. A dispenser according to claim 1 in which the boss has an inwardly tapering tear drop transverse cross section.

7. A dispenser according to claim 1 in which the boss has a ratio of radial length to height in the range of from 10:1 to 25:1.

8. A dispenser according to claim 1 in which the boss has a ratio of radial length to transverse width of from 4:3 to 2:1.

9. A dispenser according to claim 1 in which the barrel and rotor wheel are oval in transverse cross section.

10. A dispenser according to claim 1 in which the base wall of the barrel and the top surface of the rotor wheel each have an arcuate vertical profile.

11. A dispenser according to claim 10 in which the base wall of the barrel is convex and the top surface of the rotor wheel is concave, the profiles having the same radius of curvature.

12. A dispenser according to claim 1 in which the sump has a radially extending lozenge shape, having a transverse width just sufficient to seat the boss.

13. A dispenser according to claim 12 in which the barrel is formed by injection moulding into a mould and an irregular protuberance occurring within a gate to the mould is positioned within the sump, preferably radially closest to the centre of the base wall.

14. A dispenser according to claim 1 in which the sump has a similar depth throughout.

* * * * *